US011612925B2

(12) United States Patent
Duscher

(10) Patent No.: US 11,612,925 B2
(45) Date of Patent: Mar. 28, 2023

(54) BENDING MACHINE AND METHOD FOR BENDING A WORKPIECE OUT OF A FLAT MATERIAL

(71) Applicant: EVOBEND GmbH, Ainring (DE)

(72) Inventor: Nikolaus Franz Duscher, Bergheim bei Salzburg (AT)

(73) Assignee: EVOBEND GmbH

( * ) Notice: Subject to any disclaimer, the term of this patent is extended or adjusted under 35 U.S.C. 154(b) by 51 days.

(21) Appl. No.: 16/963,029

(22) PCT Filed: Jan. 16, 2019

(86) PCT No.: PCT/EP2019/051018
§ 371 (c)(1),
(2) Date: Jul. 17, 2020

(87) PCT Pub. No.: WO2019/141714
PCT Pub. Date: Jul. 25, 2019

(65) Prior Publication Data

US 2020/0346265 A1 Nov. 5, 2020

(30) Foreign Application Priority Data

Jan. 17, 2018 (DE) ..... 102018000344.3

(51) Int. Cl.
*B21D 5/04* (2006.01)
*B21D 5/00* (2006.01)
*B21D 37/12* (2006.01)

(52) U.S. Cl.
CPC ..... *B21D 5/045* (2013.01); *B21D 5/004* (2013.01); *B21D 5/042* (2013.01); *B21D 37/12* (2013.01)

(58) Field of Classification Search
CPC ..... B21D 5/045; B21D 5/042; B21D 5/004; B21D 37/12; B21D 5/04; B21D 5/047
See application file for complete search history.

(56) References Cited

U.S. PATENT DOCUMENTS 2,325,736 A * 8/1943 Bowman ..... B21D 5/042 72/319
2019/0247905 A1* 8/2019 Aigner ..... B21D 5/04
2020/0122211 A1* 4/2020 Hershberger ..... B21D 5/16

FOREIGN PATENT DOCUMENTS

AT 514821 4/2015
DE 19901797 7/2000
(Continued)

OTHER PUBLICATIONS

English translate (JPH05285545A), retrieved date Apr. 11, 2022.*

*Primary Examiner* — Shelley M Self
*Assistant Examiner* — Mohammed S. Alawadi
(74) *Attorney, Agent, or Firm* — The Belles Group, P.C.

(57) ABSTRACT

Bending machine and method for bending a workpiece out of a flat material

The invention relates to a bending machine (10) for bending a workpiece (12) out of a flat material, such as a sheet for example. A section (14) to be bent may be reshaped relative to a clamped section (16) of the workpiece (12) about at least one bending axis (18), wherein the bending machine (10) comprises: a machine frame (20); a first side clamping wall (22); a second side clamping wall (24) which can be moved relative to the first side clamping wall (22); and at least one bending unit (26, 28) comprising at least one bending tool (30). The first side clamping wall (22) and the second side clamping wall (24) are designed to clamp the workpiece (12) on a clamping plane (32). Furthermore, the bending unit (26, 28) is arranged on at least one of the first and second side clamping walls (22, 24) and is designed to bend the workpiece (12) section (14) to be bent relative to the clamped workpiece (12) section (16) about the at least one bending axis (18). According to the invention, the bending unit (26)

(Continued)

has at least one linear guide (34-46), by means of which the bending tool (30) is linearly guided in order to be moved on an advancement plane (48).

18 Claims, 6 Drawing Sheets

(56) References Cited

FOREIGN PATENT DOCUMENTS

| | | | | | |
|---|---|---|---|---|---|
| EP | 1064110 | | | 5/2003 | |
| EP | 1410855 | | | 4/2004 | |
| EP | 1797973 | | | 6/2007 | |
| EP | 1854564 | A1 | * | 11/2007 | ..... B21D 5/042 |
| EP | 1967300 | | | 9/2008 | |
| EP | 2014381 | | | 1/2009 | |
| JP | H03180215 | | | 8/1991 | |
| JP | H05285545 | | | 11/1993 | |
| JP | H05285545 | A | * | 11/1993 | |
| JP | 2010058138 | | | 3/2010 | |
| WO | WO 93/16822 | | | 9/1993 | |
| WO | WO 9316822 | | | 9/1993 | |

* cited by examiner

BENDING MACHINE AND METHOD FOR BENDING A WORKPIECE OUT OF A FLAT MATERIAL

CROSS-REFERENCE TO RELATED PATENT APPLICATIONS

The present application is a U.S. national stage application under 35 U.S.C. § 371 of PCT Application No. PCT/EP2019/051018, filed Jan. 16, 2019, which claims priority to German Patent Application No. 102018000344.3, filed Jan. 17, 2018. The disclosures of the aforementioned priority applications are incorporated herein by reference in their entireties.

The invention relates to a bending machine for bending a workpiece out of a flat material, to a bending unit and an electronic control unit for such a bending machine, and to a method for bending a workpiece out of a flat material.

Bending machines, in particular swivel bending machines for bending sheet metal and the like, in which sheet metal may be clamped and provided with straight bending points, are known from the prior art. Different bending geometries may be produced by repeated feeding and bending. Typically, a sheet metal to be reshaped is clamped by two opposite side clamping walls and bent around a bending edge by means of a bending tool that may be swiveled relative to the side clamping walls. After swiveling back the bending tool and temporarily opening the side clamping walls, the sheet metal to be reshaped may be moved relative to the side clamping walls so that after renewed clamping, another bending point may be created by swiveling the bending tool.

A swivel bending machine which has two bending tools arranged on opposite side clamping walls so that double bending is possible is known in general from the prior art; the sheet metal to be bent may thus be bent in different directions by swiveling one of the bending tools at a time.

EP 2 014 381 B1 also presents a swivel bending machine with two working tools arranged opposite each other, each having a bending arm and a holding arm. The bending arm and holding arm are connected to one another by an articulated movement mechanism having a plurality of scissor joints, so that a sheet metal to be bent may be clamped by the holding arms, while the bending arms may be swiveled relative to the holding arms to reshape the sheet metal.

DE 199 01 797 A1 also discloses a swivel bending machine, which comprises side clamping walls and bending tools hinged to the side clamping walls by means of levers, the bending tools being movable relative to the side clamping walls in a manner guided by the levers, whereby a clamped sheet metal may be reshaped.

In such prior art swivel bending machines, realizable movement paths of bending tools are defined by a geometry of the swivel mechanisms. Modification measures are therefore required in order to change the movement path.

Bending machines in which a clamping unit is arranged opposite a bending unit are also known from the prior art. A sheet metal to be reshaped is held by the clamping unit in a bending area defined by the bending unit.

Such a bending machine is known from EP 1 410 855 B1, for example. In this known bending machine, a bending unit grips clamped sheet metal from one side, while a clamping unit holds the sheet metal from an opposite side.

A similar arrangement is also known from EP 1 797 973 A1.

Furthermore, EP 1 967 300 A2 shows a system for bending sheet metal comprising a bending group that has a comparable structure.

In view of the prior art, the object of the invention is to achieve an improved design of a bending machine.

The object is achieved by a bending machine, a bending unit, an electronic control unit, and a method. Refinements of the invention may be found in the dependent claims.

The invention relates to a bending machine for bending a workpiece out of a flat material, wherein a section to be bent may be reshaped relative to a clamped section of the workpiece about at least one bending axis. The bending machine comprises a machine frame, a first side clamping wall, a second side clamping wall which may be moved relative to the first side clamping wall, and at least one bending unit comprising at least one bending tool. The first side clamping wall and the second side clamping wall are designed to clamp the workpiece in a clamping plane. The bending unit is arranged on at least one of the first and second side clamping walls. In addition, the bending unit is designed to bend the workpiece section to be bent relative to the clamped workpiece section about the at least one bending axis.

It is proposed that the bending unit has at least one linear guide, by means of which the bending tool is linearly guided in order to be moved in an advancement plane.

The bending machine according to the invention has a simple and reliable design. A bending machine may be provided which allows a high degree of flexibility with regard to a choice of movement paths. Such movement paths may include, in particular, curved non-linear movement paths that allow complex bending operations to be performed. Movement paths may be freely chosen to a large extent, in particular avoiding the usual design-related restrictions. In addition, a bending machine with a compact bending unit may be provided, which also allows bending over a wide angular range. The bending unit according to the invention may be easily moved out of the way, thus enabling a large working area to be freed up if required. In addition, movement of the bending tool may be controlled very precisely. Any forces that occur may be absorbed in a targeted manner. Furthermore, a bending machine may be provided of which the components have a stiffness and movement precision that is independent of a bending angle to the greatest possible extent. Furthermore, articulated swivel mechanisms may be spared, and yet a comparable or even improved functionality may be achieved. In addition, small counter edges, for example of less than 20 mm or even of less than 15 mm, may be produced.

The machine frame is designed to be installed on a substrate, for example a factory floor. In a regular installed state of the bending machine, the machine frame is installed on a flat substrate of which the surface normal defines a vertical axis of the bending machine.

The workpiece may be a metal sheet, for example. However, it may also be another workpiece made of a flat material. For example, the flat material may be a composite material. A flat plastic workpiece is also conceivable in principle. Preferably, the workpiece may be reshaped by bending. However, the workpiece may be made, in principle, of any material suitable for this purpose.

Preferably, the clamping plane is perpendicular to the vertical axis of the bending machine. For example, the clamping plane runs through a center of gravity of the clamped section and/or parallel to a main plane of extent thereof. In principle, however, it is also conceivable to arrange the clamping plane parallel or at any angle to the vertical axis. The bending machine may include a table on which the workpiece may be placed. In a clamped state of the workpiece and/or before the workpiece is clamped, the clamped section or a section of the workpiece to be clamped lies at least partially on the table. In addition, the bending machine may comprise a positioning unit for moving the workpiece in the clamping plane and/or parallel thereto, for example when the workpiece is placed on the table. The positioning unit may comprise a suitable drive and/or suitable stops, grippers, slides, rollers or the like to exert a positioning force and/or movement on the workpiece. It is also conceivable that at least one of the side clamping walls may be moved parallel or at any angle to the clamping plane, so that the workpiece may be moved, for example, by coordinated movements of the side clamping walls.

The first side clamping wall may be an upper side clamping wall. In this case the second side clamping wall may be a lower side clamping wall arranged opposite the first side clamping wall. Here, the second side clamping wall for example is fixed, preferably immovably, to the machine frame. It is conceivable that the first side clamping wall may be moved relative to the machine frame, especially parallel to the vertical axis of the bending machine. Preferably, the bending machine comprises at least one carrier which is swivel-mounted on the machine frame and to which the first side clamping wall is fixed. It is conceivable here that the first side clamping wall is attached to the carrier in a linearly guided manner. Preferably, the first side clamping wall is fixed immovably to the carrier. By swiveling the carrier relative to the machine frame, the first side clamping wall may be moved relative to the second side clamping wall. Alternatively or additionally, it is conceivable that the second side clamping wall may be moved relative to the machine frame, for example parallel to the vertical axis of the bending machine. Optionally, the table is connected immovably to the machine frame or may be moved relative to the machine frame. The bending machine may be equipped in this case with a drive for the table, which drive, for example, allows the table to be extended and/or raised or lowered. It is conceivable that the first side clamping wall and the second side clamping wall may be moved relative to the table, especially in a positive or negative vertical direction parallel to the vertical axis of the bending machine.

At least one of the first and second side clamping walls has a clamping surface which is brought into contact with the workpiece when this is in the clamped state. The clamping surface may be arranged parallel to the clamping plane, at least in the clamped state of the workpiece. The workpiece may be reliably clamped if the first side clamping wall and the second side clamping wall each have a clamping surface, and the clamping surfaces of the side clamping walls are arranged opposite each other. This allows the workpiece to be held from above and below by the side clamping walls.

A surface of at least one of the side clamping walls facing away from the clamping plane and/or the clamped section of the workpiece preferably runs at an angle with respect to the clamping plane and encloses, for example, an angle with the clamping plane which is less than 90°, preferably not more than 45°, preferably not more than 30° and particularly preferably not more than 45°. This surface is advantageously flat. The correspondingly different side clamping wall may also have a surface that is mirror-symmetrical to this surface with respect to the clamping plane. In this case, the side clamping walls are preferably arranged in a V arrangement, and the clamping plane may define a bisector. In the clamped state of the workpiece, the clamped section is arranged within a clamping area defined by the side clamping walls, which may also include the table, for example. The workpiece may protrude from the clamping area between the side clamping walls, for example between their clamping surfaces, with a protruding section of the workpiece then forming the section to be bent.

For example, at least one of the side clamping walls may be designed as a chamfered plate, with the chamfer forming one of the clamping surfaces. A longitudinal axis of the side clamping wall preferably runs substantially parallel to the bending axis. The bending axis preferably runs parallel to the substrate and/or perpendicular to the vertical axis of the bending machine. The bending axis is preferably parallel to a longitudinal axis of the bending machine. In addition, a transverse axis of the bending machine is preferably perpendicular to the longitudinal axis and perpendicular to the vertical axis of the bending machine. Preferably, sections of the side clamping walls comprising at least the clamping surfaces are arranged mirror-symmetrically to each other with respect to the clamping plane.

The bending tool may have an extent along the longitudinal axis of the bending machine that corresponds substantially to an extent of the corresponding side clamping wall along the longitudinal axis. Uniform bending may be achieved, for example, if the bending tool is designed to apply a bending force to the workpiece over its entire length along the bending axis. This allows a bending point to be created along the bending axis when the tool is bent.

The linear guide of the bending unit may define a guide axis that runs parallel to the advancement plane and, in particular, lies in the advancement plane. Preferably, the bending unit has a plurality of linear guides, which are arranged at different positions along the longitudinal axis, in particular at uniform intervals. Guide axes of the linear guides are preferably arranged parallel to each other.

A bending machine with which a high degree of versatility may be achieved with regard to realizable bending geometries may be provided, in particular if a bending unit is arranged on each of the side clamping walls. Preferably, the bending units are substantially identical in their design. It is also conceivable that bending units of different designs are used. The bending unit arranged on the first side clamping wall may be set up to bend the section to be bent towards the second side clamping wall and/or the bending unit arranged on the second side clamping wall may be set up to bend the section to be bent towards the first side clamping wall.

According to a further embodiment of the invention, the bending unit comprises at least one drive for the bending tool, which drive is designed to move the bending tool in the advancement plane. The drive for the bending tool is preferably a linear drive. Likewise, the drive for the bending tool may be a lever drive. However, a hydraulic drive or any other drive is also conceivable. The drive for the bending tool may, for example, comprise and/or be designed as a linear drive with a roller screw drive, a linear drive with a drive cylinder, an electromagnetic linear motor or the like. In addition, the drive for the bending tool may comprise a plurality of linear drives arranged in series or parallel. Alternatively, the drive for the bending tool may comprise a rotary drive such as an electric motor, and suitable elements such as levers, crankshafts or the like for converting a rotary movement into a linear movement. Preferably, the drive for the bending tool has at least one ball screw drive. Particularly preferably, the bending unit comprises a plurality of drives for the bending element, which drives may be arranged at regular intervals in a direction parallel to the bending axis. A number of linear guides for the bending tool and a number of drives for the bending tool may be identical or different.

The advancement plane may intersect the clamping plane or run parallel to it. If the advancement plane and the clamping plane intersect, their intersection line is preferably parallel to the bending axis or coincides with it. When bending, the advancement plane may move in translation relative to the clamping plane and/or relative to the bending axis. This allows a movement path of the bending tool to be precisely traced.

A simple change of the bending tool may be made possible in particular if the bending unit includes a bending tool carrier to which the bending tool is secured in an exchangeable manner. In this way, different bending tools may be used easily if required. The bending tool carrier is preferably guided directly by the linear guide. In addition, the drive of the bending tool may act directly on the bending tool carrier. A movement of the bending tool carrier may be directly transferred to the bending tool attached to the bending tool carrier, so that the bending tool may be moved guided by the linear guide and/or moved by the drive of the bending tool in a state secured to the bending tool carrier.

A large freedom of design with regard to realizable movement paths of the bending tool may be achieved in particular if the bending unit comprises a base element movably mounted on the side clamping wall associated with it, on which base element the bending tool is mounted so that it may be moved linearly. The base element may have opposite sides which enclose an angle of less than 90° but more than 0°. An upper side of the base element facing away from the corresponding side clamping wall may be inclined with respect to the side clamping wall. For example, the base element is triangular and/or three-sided in cross-section. Especially because of its triangular cross-section, the base element may adjust the bending tool and/or the advancement plane relative to the side clamping wall associated with the bending unit. For example, in an area of the bending axis, the bending tool may thus be advanced at an angle of at least 45° and advantageously at least 60°, for example if the base element is moved to a front area, for example an area of the clamping surface, of the side clamping wall associated with the bending unit and the bending tool is displaced in the advancement plane. Preferably, a longitudinal axis of the base element is arranged substantially parallel to the bending axis. The bending tool may be linearly guided on a side of the base element facing away from the corresponding side clamping wall. This side of the base element is preferably arranged substantially flat and/or parallel to the advancement plane. Furthermore, a side of the base element opposite this side may be arranged on the surface of the corresponding side clamping wall facing away from the clamping plane and/or the clamped section of the workpiece in a movable manner and/or parallel to this surface.

If the linear guide and/or the drive for the bending tool are integrated in the base element, a bending machine with a space-efficient bending unit may be provided. It is conceivable that the linear guide is integrated into the drive for the bending tool. Preferably, the linear guide and the drive for the bending tool are designed separately, with the drive for the bending tool being able to provide a further linear guide for the bending tool. An available installation space may be used particularly efficiently if a spindle of the drive for the bending tool is integrated into the base element and a nut running on the spindle is rigidly connected to the bending tool and/or to the bending tool carrier. It is also conceivable that the spindle is integrated into the bending tool carrier.

According to one embodiment of the invention, the bending unit comprises at least one further linear guide, with which the base element is linearly guided for displacement in a further advancement plane. This enables a wide range of possible movement paths to be realized, with the stiffness of moving components being independent, where possible, of the corresponding movement path, so that complex corrections are not necessary. For bending, the bending tool is movable in the advancement plane and in the further advancement plane. A movement of the bending tool may be a superimposed movement in the advancement plane and in the further advancement plane, with the base element preferably moving relative to the corresponding side clamping wall and the bending element relative to the base element. The base element is preferably designed such that the linear guide and the further linear guide enclose an angle which lies between 0° and 90°, this angle preferably corresponding to the angle between the advancement planes and/or the angle between the opposite surfaces of the base element.

Additional freedom with regard to the movability of the bending tool may be achieved in particular if the bending unit comprises at least one drive for the base element, which drive is designed to move the base element in the further advancement plane. The drive for the base element is preferably a linear drive. The drive for the base element may also be a lever drive. However, a hydraulic drive or any other drive is also conceivable. The drive for the base element may, for example, comprise or be designed as a linear drive with a roller screw drive, a linear drive with a drive cylinder, an electromagnetic linear motor or the like. In addition, the drive for the base element may comprise a plurality of linear drives arranged in series or parallel. Alternatively, the drive for the base element may comprise a rotary drive such as an electric motor and suitable elements such as levers, crankshafts or the like for converting a rotary movement into a linear movement. Preferably, the drive for the base element has at least one ball screw drive.

If the further linear guide and/or the drive for the base element are partially integrated in the side clamping wall associated with the bending unit, a bending machine with a compact bending unit may be provided. The drive for the base element is also preferably partially integrated into the base element. It is conceivable that the further linear guide is integrated into the drive for the base element. Preferably, the further linear guide and the drive for the base element are designed separately, and the drive for the base element may provide an additional linear guide for the base element. An available installation space may be used particularly efficiently if a spindle of the drive for the base element is at least partially accommodated in the base element. The spindle may be stationary in relation to the side clamping wall associated with the bending unit, with the base element being connected to a nut running on the spindle. The opposite case is also conceivable, however. The bending unit particularly preferably comprises a plurality of drives for the base element, which may be arranged at regular intervals in a direction parallel to the bending axis. In addition, the bending unit may comprise a plurality of further linear guides for the base element, which may also be arranged offset to each other correspondingly. A number of further linear guides and a number of drives for the base element may be identical or different. Preferably, the drive(s) for the bending tool and the drive(s) for the base element are arranged offset to each other, approximately in a direction parallel to the bending axis.

The drive for the bending tool and/or the drive for the base element may be free of drive hydraulics. Preferably, the drive for the bending tool and/or the drive for the base element, preferably in each case, comprise at least one servo motor, whereby the corresponding drive may be controlled precisely and easily. The bending unit may be completely free of hydraulics, making it energy efficient and reliable. In addition, the bending unit may be easily manufactured because no hydraulic components are required.

If the further advancement plane is arranged substantially parallel to the surface of the side clamping wall associated with the bending unit, a large travel range may be achieved. The further advancement plane is preferably stationary relative to the side clamping wall associated with the bending unit. In the clamped state of the workpiece, the further advancement plane may also be stationary relative to the clamping plane and/or the bending axis.

A high degree of compactness in combination with versatile design options for different movement paths may be achieved in particular if the advancement plane intersects the further advancement plane. Preferably, an intersection line of the advancement plane and the further advancement plane is parallel to and/or coincides with the bending axis. The advancement plane and the further advancement plane preferably enclose an angle defined by the triangular geometry of the base element in cross-section. The angle between the advancement plane and the further advancement plane is preferably constant. However, it is conceivable that the angle may be changed, for example by designing the base element in such a way that the angle between the upper side and lower side of the base element may be adjusted. In such a case, the base element may be spread further or less far, as required, whereby the advancement plane may be inclined relative to the further advancement plane as required. If the base element is moved relative to the side clamping wall associated with the bending unit, for example moved by the drive of the base element, the advancement plane moves relative to the further advancement plane and/or relative to the bending axis. If, alternatively or additionally, the bending tool is moved in the advancement plane, for example by the drive of the bending tool, a movement path of the bending tool may be traced by coordinated superimposition of movements of the base element and the bending tool. In particular, since the advancement plane and the further advancement planes are set relative to each other and also relative to the clamping plane, a movement path to be traversed may be freely designed.

According to a further embodiment of the invention, at least one of the first and second side clamping wall has a bending edge which defines the bending axis when bending is performed by means of the bending unit. The bending edge may extend parallel to the longitudinal axis of the bending machine. When bending, the base element may be moved so close to the bending edge that the bending tool protrudes over the bending edge when viewed from the clamped section, so that the workpiece may be bent by moving the bending tool and/or the base element around the bending edge. The bending edge associated with the bending unit is preferably a bending edge of the corresponding other side clamping wall, i.e. the side clamping wall with which the bending unit is not associated. Preferably, the first side clamping wall has a first bending edge and the second side clamping wall has a second bending edge.

A high degree of versatility with regard to realizable bending angles and geometries of bent parts may be achieved in particular if the bending tool is movable in such a way that the workpiece may be bent around the bending edge by at least 120° and preferably by at least 130°, preferably by up to 140° or even further. Preferably, a maximum swivel range on a side of the side clamping walls facing away from the clamped section extends starting from the clamping plane over an angular range of at least 120° and preferably at least 130°, preferably up to 140° or even further. The maximum swivel range is limited in particular by the other bending unit, for example when it is in a fully retracted state. If, for example, the bending unit is arranged on the first side clamping wall and the other bending unit is arranged on the second side clamping wall, the section to be bent may be bent by means of the bending unit within the swivel range, for example around a bending edge formed on the second side clamping wall, when the other bending unit is in the fully retracted state. In this way, bent parts with internal angles of, for example, 50° and preferably 40° may be produced by means of the bending unit.

According to a refinement of the invention, the bending tool comprises a hook-shaped bending section. This allows the bending tool to be used for different bending modes. The bending section of the bending tool may be hook-shaped when viewed parallel to the bending axis. Preferably, the bending section of the bending tool has a substantially constant and preferably hook-shaped cross-section in a direction parallel to the bending axis. The bending section of the bending tool may be set up to be optionally pressed with an outer side against the section to be bent when bending the workpiece. In addition, the bending section of the bending tool may be set up to be selectively pressed with an inner side, for example with a hook inner area of the bending section of the bending tool, against the section to be bent during bending. The inner region of the hook may then engage around an already partly formed bending point. Preferably the inside of the bending section of the bending tool faces the clamping area defined by the side clamping walls and/or the outside of the bending section of the bending tool faces away from the clamping area defined by the side clamping walls.

In principle, however, any geometries of the bending tool are conceivable, and may be adapted in particular to a bending geometry to be produced. For example, the bending section of the bending tool may have a rounded and/or circle segment-shaped and/or ellipsis segment-shaped and/or polygonal cross-section. For example, if only bending angles of up to 90° or up to 100° are to be produced, a semicircular and/or arcuate bending section may be expedient. Preferably, the bending section is rounded at least in some sections so that it may roll over the section to be bent during bending. It is alternatively or additionally conceivable that the bending section at least in some sections has a flat surface which may be brought into contact with the section to be bent during bending.

Large bending angles may be easily produced if the bending unit is designed to move the bending tool in a first direction in a push bending mode and in a second direction, different from the first direction and preferably substantially opposite the first direction, in a pull bending mode. In the push bending mode, a positive feed may take place in the advancement plane and/or in the further advancement plane. Furthermore, in the pull bending mode, a negative feed in the advancement plane and/or in the further advancement plane may take place. Positive feed in this case preferably refers to a feed in the direction of the bending area. In the push mode, preferably the outside of the bending section of the bending tool is pressed against the section to be bent, and the section to be bent may be pushed away from the bending unit about the bending axis. In particular, bending angles of up to at least 70°, preferably of up to at least 80° and particularly preferably of up to at least 90° may be produced in the push bending mode. In the pull mode, on the other hand, preferably the inner side and preferably the inner region of the hook of the bending section of the bending tool is pressed against the section to be bent, and the section to be bent may be pulled towards the bending unit about the bending axis. In particular, bending angles of at least 90°, preferably of at least 120° and particularly preferably of at least 130°, but ideally of 140° and more, may be produced in the pull bending mode. The pull bending mode may follow the push bending mode. For example, the push bending mode may be applicable for bending up to a limit angle, for example 80° or 90°, whereas the pull bending mode may be applicable from this limit angle, for example in the case where a small internal angle is to be produced. A bending point may thus be created by first partially reshaping the section to be bent in the push bending mode and then further reshaping in the pull bending mode.

In principle, a bending operation in which both bending units are used simultaneously is also conceivable. For example, one bending unit may be used to provide a countersupport, so that the other bending unit bends a section to be bent around a bending tool of the counter-supporting bending unit. In this way, small counter bends may be manufactured precisely. In addition, a plurality of bending points may be produced without having to move the workpiece.

Furthermore, the bending unit may be modified according to one embodiment of the invention in such a way that three or more different advancement planes are provided. For this purpose, for example, the base element may be composed of a plurality of elements, in particular with a triangular and/or three-sided cross-section, which are each mounted so as to be linearly movable relative to one another. For example, a first such element of the base element may be mounted on the corresponding side clamping wall. In addition, a second such element, on which in particular the bending tool and/or the bending tool carrier is mounted in a linearly movable manner, may be mounted on the first such element in a linearly movable manner. In principle, any number of such elements is conceivable here, and a corresponding number of different advancement planes may also be realized.

The invention also relates to a bending unit for a bending machine according to the invention, with at least one bending tool and with at least one linear guide, with which the bending tool is linearly guided in order to be moved in an advancement plane. The bending unit may be partially integrated into a side clamping wall of the bending machine.

The bending unit according to the invention has a compact design. In addition, the bending unit may be used to produce a large number of different geometries of a bent part, especially geometries with small internal angles and/or small counter edges. Due to their compactness, the components of the bending unit may be easily moved out of the way, thus allowing a workpiece to be bent over a wide angular range.

Furthermore, the invention relates to an electronic control unit for a bending machine according to the invention, which is designed to produce a movement path for the bending tool by superimposing at least two linear movements. The preferred movement path is a curved path defining a non-linear movement. The movement path particularly preferably runs in a plane perpendicular to the bending axis. For example, the movement path may be a path of a movement of a specific unchanged but moving point of the bending tool, for example a foremost point of the bending section of the bending tool. Preferably, the control unit is designed to control the drive of the bending tool and/or the drive of the base element. The control unit may be designed to produce control signals which are intended to cause a movement of the bending tool in the advancement plane and also a movement of the base element in the further advancement plane. The control unit may be designed to superimpose the two movements in the advancement plane and the further advancement plane in such a way that different non-linear movement paths may be produced. The control unit according to the invention makes it possible to freely design movement paths for the bending tool in a simple manner. By specifying a movement path suitably, a desired geometry of a bent part may be produced without the need for complex modification measures on a bending machine. The control unit also makes it possible to produce movement paths independently of articulated or generally mechanical swivel mechanisms, as is the case in accordance with the prior art.

Furthermore, the invention relates to a method for bending a workpiece out of a flat material, such as a sheet metal, preferably with a bending machine according to the invention. In the method, the workpiece is clamped in a clamping plane by means of two side clamping walls. In addition, a section of the workpiece to be bent, for bending relative to a clamped section of the workpiece by means of a bending tool linearly guided in an advancement plane, is reshaped about a bending axis by moving the bending tool in a linearly guided manner in the advancement plane.

The method according to the invention allows a high degree of versatility with regard to a choice of movement paths. Movement paths may be chosen freely to a large extent, in particular by avoiding the usual design-related restrictions of the prior art. In addition, a movement of the bending tool may be controlled very precisely. Any forces that occur may be absorbed in a targeted manner. In addition, articulated swivel mechanisms may be spared, and yet a comparable or even improved functionality may be achieved.

According to a refinement of the method, the bending tool is moved along a movement path produced by superimposing a plurality of linear movements. The linear movements are preferably a first linear movement in the advancement plane and a second linear movement in the further advancement plane. The movement path may be produced in particular with a control unit according to the invention. In this way, a point of application of the bending tool may be optimized depending on the nature of the workpiece and, for example, adjusted during bending. In particular, it may also be used to ensure that sensitive surfaces of the workpieces to be reshaped are not damaged.

In the following, the present invention is described by way of example with reference to the attached figures. The drawing, the description and the claims contain numerous features in combination. A person skilled in the art will also expediently consider the features individually and combine them to form further meaningful combinations. In the drawings:

Figure 1:
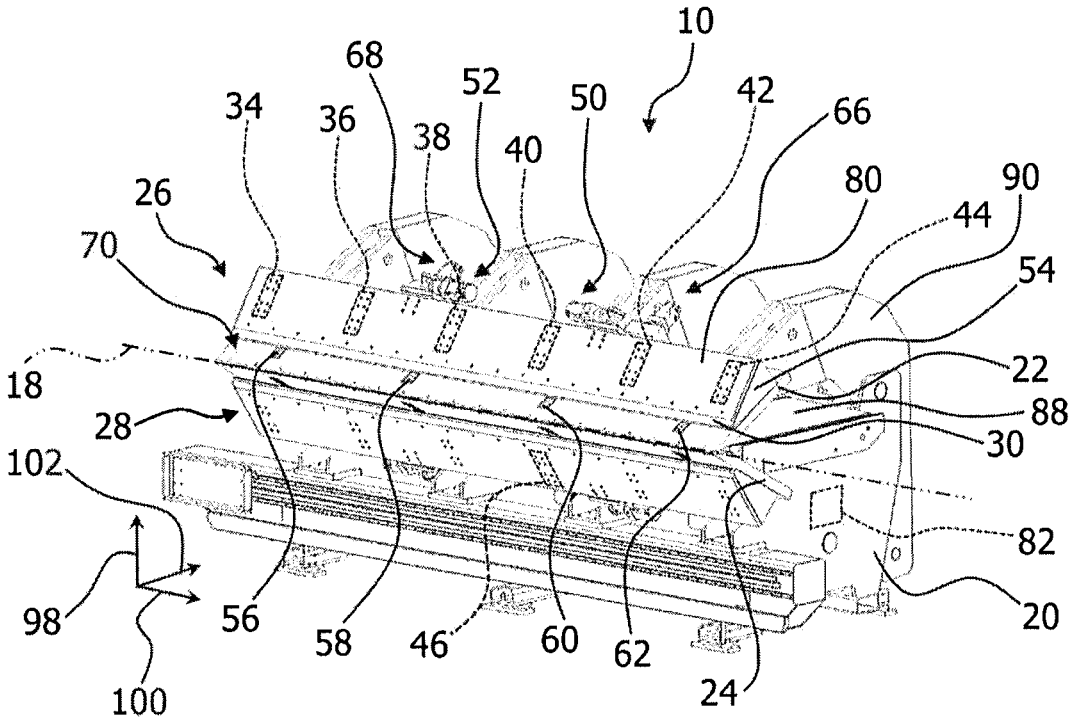
FIG. 1 shows a schematic perspective view of a bending machine according to the invention.
Figure 2:
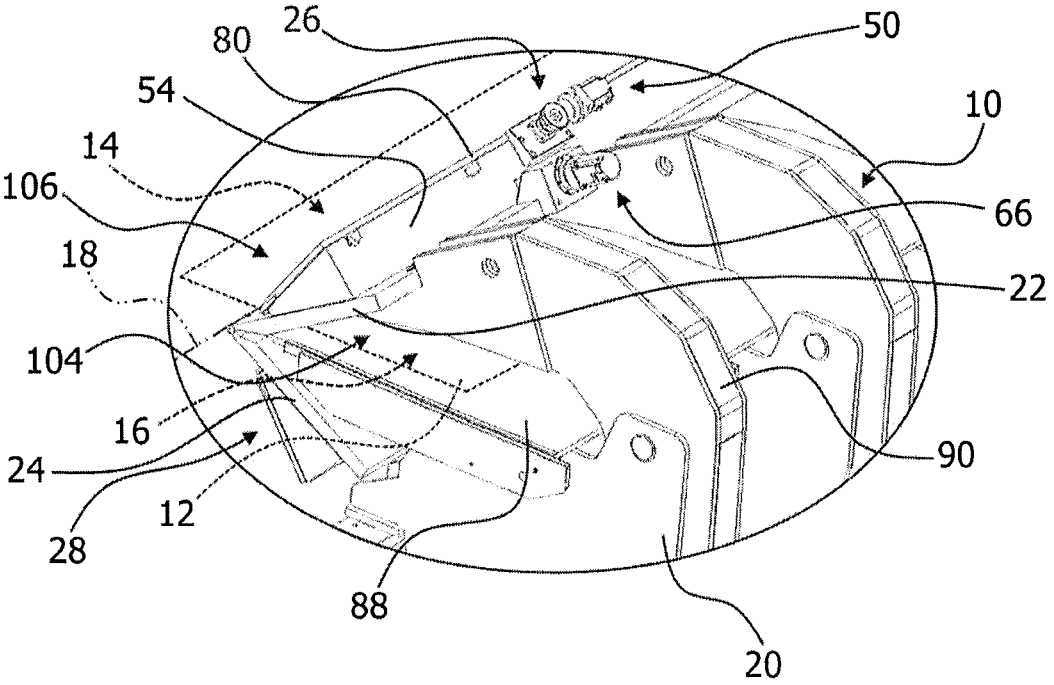
FIG. 2 shows a schematic perspective view of a section of a rear side of the bending machine.
Figure 3:
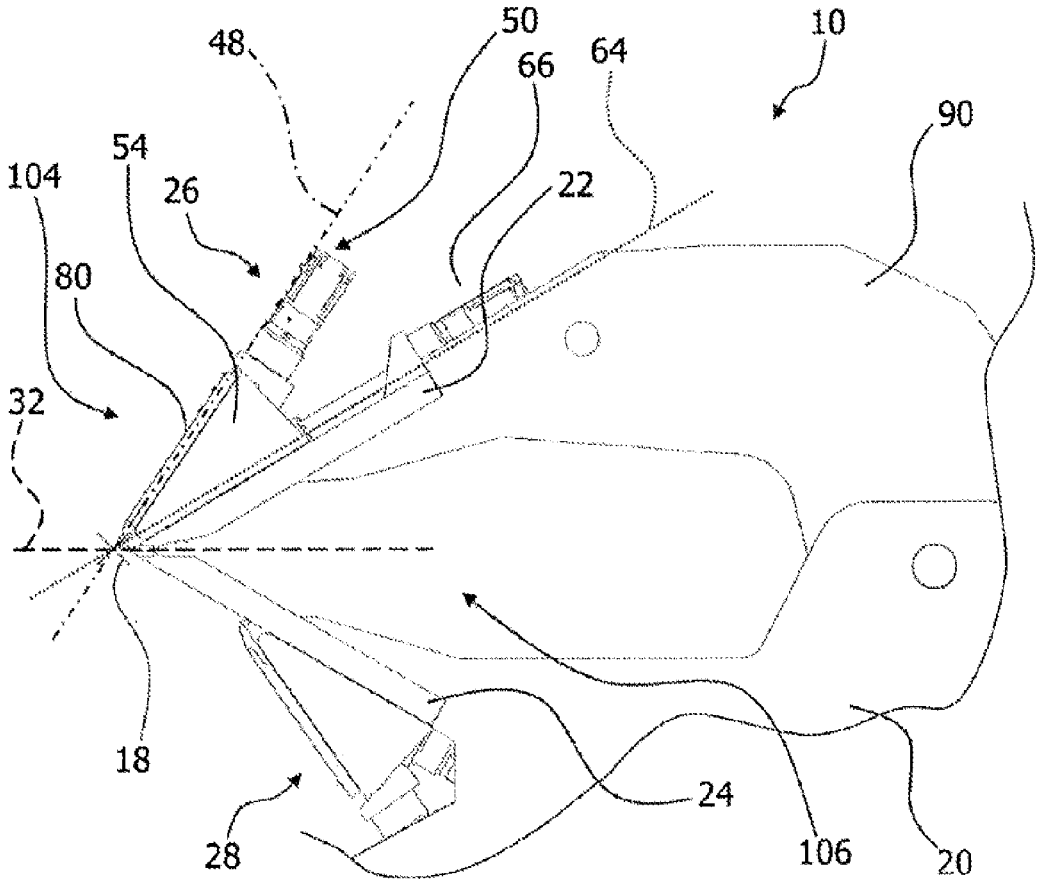
FIG. 3 shows a schematic side view of a section of the bending machine.

FIG. 1 shows a perspective view of a bending machine 10 according to the invention. FIG. 2 shows a section of a rear side of the bending machine 10 in a perspective view. In addition, FIG. 3 shows a side view of a section of the bending machine 10. In the following, reference is made in part to a number of these figures at the same time. The bending machine 10 is designed for bending a workpiece 12 out of a flat material. In the case shown, the workpiece 12 is a sheet metal.

The bending machine comprises a machine frame 20. The bending machine 10 is installed on a flat substrate via the machine frame 20. A surface normal of the flat substrate defines a vertical direction 98, with a vertical axis of the bending machine 10 (not shown) being arranged parallel to the vertical direction. The bending machine 10 also has a longitudinal axis (not shown) and a transverse axis (not shown), which are arranged parallel to a longitudinal direction 100 and a transverse direction 102 respectively. In the present case, the vertical direction 98, the longitudinal direction 100 and the transverse direction 102 are arranged in pairs perpendicular to each other.

In addition, the bending machine 10 comprises a first side clamping wall 22 and a second side clamping wall 24. The first side clamping wall 22 is an upper side clamping wall in the case shown, while the second side clamping wall 24 is a lower side clamping wall.

The first side clamping wall 22 and the second side clamping wall 24 are designed to clamp the workpiece 12 in a clamping plane 32. The clamping plane 32 is arranged parallel to the flat substrate or parallel to the horizontal direction 102 and perpendicular to the vertical direction 98. The workpiece 12 is clamped in such a way that it comprises a clamped section 16 and a section 14 to be bent. The section 14 to be bent and the clamped section 16 are connected in one piece and are directly adjacent to each other.

The embodiment shown is to be understood as a purely exemplary arrangement of the side clamping walls 22, 24. Thus, in an alternative embodiment, the first side clamping wall 22 may be a lower side clamping wall and the second side clamping wall 24 may be an upper side clamping wall. In addition, arrangements are also conceivable in which the side clamping walls 22, 24 are arranged in such a way that the clamping plane 32 is parallel and/or at any other angle to the vertical direction 98.

The side clamping walls 22, 24 have a planar design. In the case shown, the side clamping walls 22, 24 are steel plates. The side clamping walls 22, 24 each have a clamping surface 84, 86, which are applied to the workpiece 12 in the clamped state thereof. The clamping surfaces 84, 86 are arranged parallel to the clamping plane 32. In a region of the clamping surfaces 84, 86 the side clamping walls 22, 24 taper, with the clamping surfaces 84, 86 being smaller than a cross-section of their respective side clamping walls 22, 24 perpendicular to the bending axis 18 in a region of constant thickness of the respective side clamping walls 22, 24.

The side clamping walls 22, 24 define a clamping area 106 of the bending machine 10, within which the clamped section 16 of the workpiece 12 is situated. The side clamping walls 22, 24 are arranged at an angle of less than 90° to each other and define a triangular cross-section of the clamping area 106. In the case shown, this angle is about 60°, for example. The workpiece 12 emerges from the clamping area 106 between the side clamping walls 22, 24 into a bending area of the bending machine 10, within which the section 16 of the workpiece 12 to be bent may be swiveled during bending.

The bending machine 10 has at least one table 88, on which the workpiece 12 is placed. The table 88, for example, is arranged so that it may be moved within the clamping area 106. In addition, the table 88 may be either movable relative to the machine frame 20 or fixed. In the case shown, the table 88 may be extended parallel to the clamping plane 32. Furthermore, the table 88 may be moved parallel to the vertical direction 98, for example by at least a few centimeters. In a clamped state, the workpiece 12 is clamped between the side clamping walls 22, 24 and additionally set down in some sections on table 88. The bending machine 10 also includes a positioning unit (not shown), which is designed to move workpiece 12 parallel to a surface of the table 88. If the workpiece 12 is released by the side clamping walls 22, 24, it may be advanced between the side clamping walls 22, 24 by means of the positioning unit.

The bending machine 10 may have a plurality of tables arranged next to each other, for example if the bending machine 10 is composed of a plurality of sections.

The first side clamping wall 22 is attached to a plurality of carriers 90, of which only one is provided with a reference sign. The carriers 90 are swivel-mounted on the machine frame 20. The second side clamping wall 24 is fixed to the machine frame 20. By swiveling the carriers 90, the first side clamping wall 22 may be swiveled relative to the second side clamping wall 24 appropriately, whereby the workpiece 12 may be clamped and released.

As mentioned above, it is also possible that both side clamping walls 22, 24 may be moved relative to the machine frame 20. The bending machine 10 may have suitable drives for this. In this way, the side clamping walls 22, 24 may be moved, for example, perpendicular to the clamping plane 32 and/or also parallel to it. In principle, it is also possible to move the workpiece 12 in the clamping plane 32 by moving the side clamping walls 22, 24 once or several times and by suitably clamping and releasing the workpiece 12 parallel to the clamping plane 32 once or several times.

The bending machine 10 also comprises a first bending unit 26, which is arranged on the first side clamping wall 22. In the case shown, the bending machine 10 further comprises a second bending unit 28, which is arranged on the second side clamping wall 24. The first bending unit 26 and the second bending unit 28 are arranged substantially identically and mirror-inverted. In the following, only the design of the first bending unit 26 will be discussed primarily. However, the description of the first bending unit 26 may be transferred to the second bending unit 28 accordingly. In principle, however, there may be design differences between the bending units 26, 28. As mentioned above, different bending units may be used. It is also conceivable that only one or more upper or only one or more lower bending unit/bending units is/are present.

The first bending unit 26 is designed to bend the section 14 of the workpiece 12 to be bent relative to the clamped section 16 of the workpiece 12 about a bending axis 18 of the bending machine 10. The bending axis 18 runs parallel to the longitudinal direction 100. The bending axis 18 defines a connecting area of the clamped section 16 of the workpiece 12 and the section 14 of the workpiece 12 to be bent.

The first bending unit 26 has at least one linear guide 34-44 with which the bending tool 30 is linearly guided for displacement in an advancement plane 48 (see FIG. 3). In the case shown, the first bending unit 26 has six linear guides 34-44. The linear guides 34-44 are arranged at regular intervals in the longitudinal direction 100.

The second bending unit 28 also has six linear guides 46, of which only one is provided with a reference sign for reasons of improved clarity.

However, as mentioned above, a bending machine according to the invention may also have a single bending unit in a modification, which bending unit may be arranged on any side clamping wall. It is also conceivable that a bending machine according to the invention comprises structurally different bending units.

Figure 7:
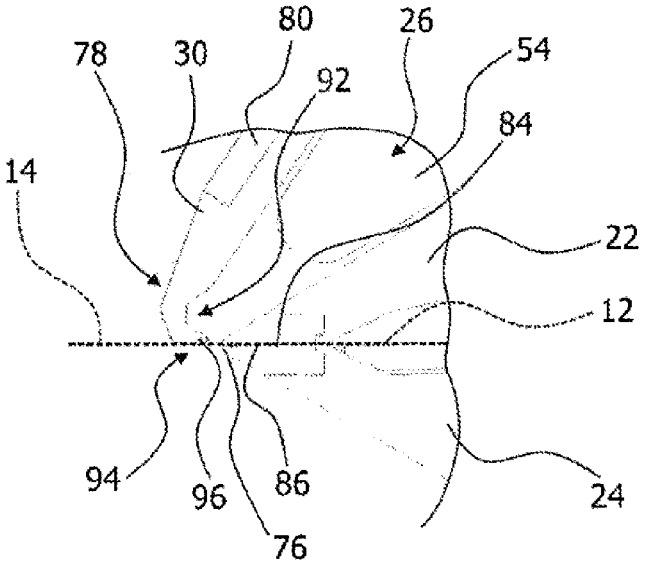
FIG. 7 shows a schematic side view of further section of the bending machine in a state immediately before bending.

The first bending unit 26 comprises a bending tool carrier 80, to which the bending tool 30 is secured in an exchangeable manner (see also FIG. 7). In the case shown, the bending tool 30 is placed with a form fit against the bending tool carrier 80 and is also screwed to it. The bending tool carrier 80 is substantially planar. One main plane of extent of the bending tool carrier 80 extends parallel to the advancement plane 48. The linear guides 34-44 are designed for linear guidance of the bending tool carrier 80. Since the bending tool 30 is secured to the bending tool carrier 80, the linear guides 34-44 guide the bending tool 30 as a result of this.

The first bending unit 26 comprises a base element 54 movably mounted on the first side clamping wall 22, on which base element the bending tool 30 is mounted so as to be linearly movable. The linear guides 34-44 for the bending tool 30 are integrated in the base element 54.

The first bending unit 26 comprises a further linear guide 56, with which the base element 54 is linearly guided for displacement in a further advancement plane 64. The further linear guide 56 guides the base element 54 parallel to a surface of the first side clamping wall 22. In the case shown, the bending unit 26 comprises four further linear guides 56-62 for the base element 54, which are arranged at regular intervals in the longitudinal direction 100. The other linear guides 56-62 for the base element 90 are arranged offset in the longitudinal direction 100 relative to the linear guides 34-44 for the bending tool 30.

The base element 54 has a triangular cross-section perpendicular to the bending axis 18. The base element 54 is designed as an element with a triangular cross-section extended in longitudinal direction 100. An upper side of the base element 54 is arranged parallel to the advancement plane 48. In addition, a lower side of the base element 54 is arranged parallel to the further advancement plane 64. The upper and lower sides of the base element 54 enclose an angle of less than 90°. However, it is also conceivable that the upper and lower sides of the base element 54 enclose an angle of 90°. The further advancement plane 64 is again arranged parallel to an upper side of the first side clamping wall 22.

In FIG. 3, the bending machine 10 is shown in a state in which the first bending unit 26 has moved forward into an area of the bending axis 18. Furthermore, in the state shown in FIG. 3, the second bending unit 28 has moved back on the second side clamping wall 24, i.e. moved away from the bending axis 18, so that the largest possible bending area in front of the second side clamping wall 24 is released, into which the section 14 of the workpiece 12 to be bent may be bent optionally.

By moving the base element 54 in the further advancement plane 64 relative to the first side clamping wall 22 and by moving the bending tool 30 in the advancement plane 48 relative to the base element 54, the bending tool 30 may be moved along a movement path to bend the workpiece 12. By superimposing the movements in the advancement plane 48 and in the further advancement plane 64, a total movement of the bending tool 30 relative to the clamping plane or relative to the workpiece 12 may be produced, and a very wide variety of movement paths may be produced. This will be discussed again below.

When moving the base element 54 relative to the first side clamping wall 22, the advancement plane 48 is also moved relative to the bending axis 18 along the other advancement plane 64. The other advancement plane 64, on the other hand, is stationary relative to the bending axis 18.

The advancement plane 48 intersects the further advancement plane 64, and an intersection line of the advancement plane 48 and the further advancement plane 64 is arranged parallel to the bending axis 18. If the bending tool 30 and/or the base element 54 is moved appropriately, the intersection line may coincide with the bending axis 18. In addition, both the advancement plane 48 and the further advancement plane 64 intersect the clamping plane 32. If the bending tool 30 and/or the base element 54 is moved appropriately, intersection lines of the clamping plane 32 and the advancement plane 48 as well as of the clamping plane 32 and the further advancement plane 64 may coincide, for example also with the bending axis 18. The advancement plane 48 is set at an angle of 25° relative to the further advancement plane 64, for example. This angle corresponds to an angle between the upper and lower sides of the base element 54. In addition, the further advancement plane 64 is tilted relative to the clamping plane 32 by, for example, 30°. This angle corresponds to a half angle between the side clamping walls 22, 24.

However, as mentioned above, other angles between the advancement plane 48 and the further advancement plane 64 are also conceivable.

According to a further embodiment of the invention, the base element 54 is composed of a plurality of elements, each of which is linearly movable relative to the other (not shown). According to one embodiment of the invention, these elements each have a triangular cross-section, so that a plurality of advancement planes arranged at an angle to one another are formed in addition to the advancement plane 48 of the bending tool 30. One of these elements may be mounted on the corresponding side clamping wall 22, 24 in such a way that it may move linearly, whereas the bending tool 30 may be mounted on another of these elements in such a way that it may move linearly.

Figure 4:
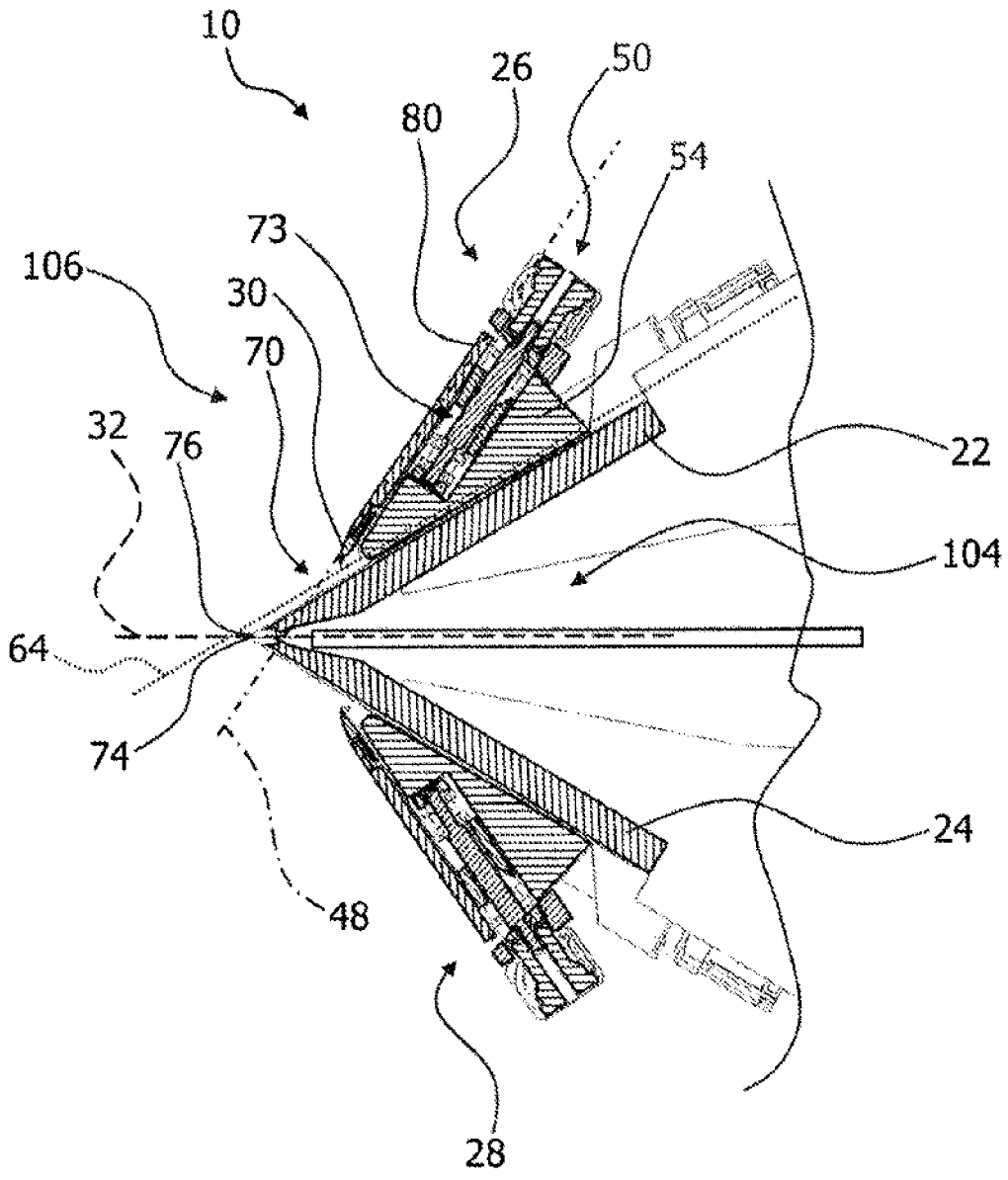
FIG. 4 shows a schematic sectional view of a section of the bending machine, cut in a sectional plane perpendicular to a bending axis of the bending machine.

FIG. 4 shows a schematic sectional view of a detail of the bending machine 10, cut in a cutting plane perpendicular to the bending axis 18 The first bending unit 26 has a drive 50 for the bending tool 30, which is set up to move the bending tool 30 in the advancement plane 48. As may be seen in FIG. 1, the bending machine 10 comprises two drives 50, 52 for the bending tool 30. The drives 50, 52 for the bending tool 30 are of identical design in the case shown, which is why only the drive 50 is described in more detail.

The drive 50 is integrated in the base element 54. The drive 50 may be moved together with the base element 54.

The drive 50 is a linear drive. The drive 50 comprises a ball screw drive 73, with a spindle of the ball screw drive 73 being integrated into the base element 54. A nut running on the spindle of the ball screw drive 73 is secured to the bending tool carrier 80. This allows the bending tool carrier 80 and thus the bending tool 30 to be moved relative to the base element 54 in the advancement plane 48 by means of the drive 50.

The drives 50, 52 for the bending tool 30 are arranged offset to the linear guides 34-44 for the bending tool 30 in the case shown. In an alternative embodiment, however, linear guides for the bending tool 30 may also be integrated in the drives 50, 52.

Figure 5:
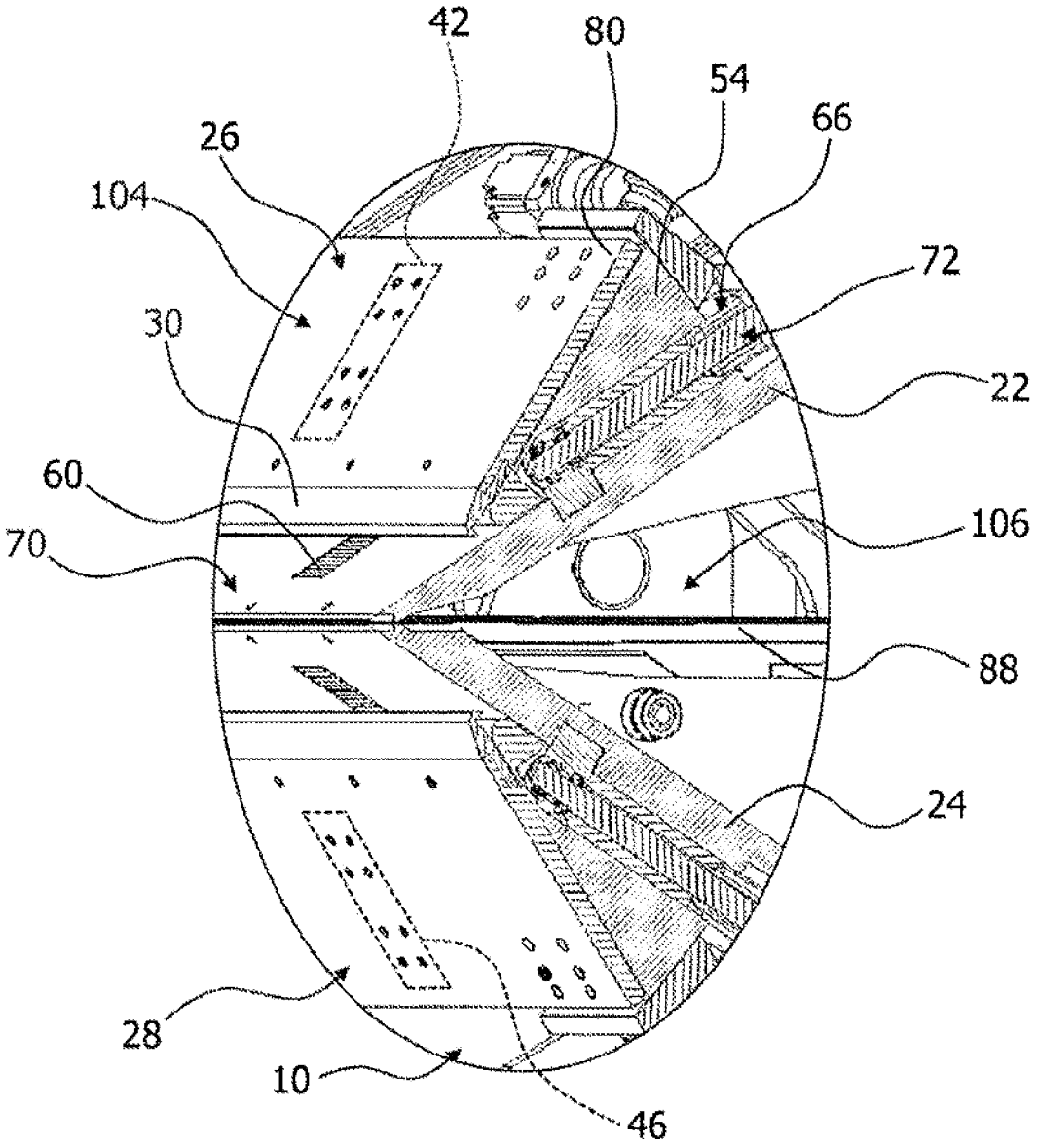
FIG. 5 shows a schematic perspective sectional view of a section of the bending machine, cut in a further sectional plane perpendicular to the bending axis of the bending machine.

FIG. 5 shows a schematic perspective sectional view of a detail of the bending machine 10, cut in a further sectional plane perpendicular to the bending axis of the bending machine 10 The first bending unit 26 comprises a drive 66 for the base element 54, which is designed to move the base element 54 in the further advancement plane 64. In the case shown, the first bending unit 26 comprises two drives 66, 68 for the base element 54. The drives 66, 68 are arranged on the first side clamping wall 22. The drives 66, 68 for the base element 54 are identical in the case shown, which is why only the drive 66 is described in more detail.

The drive 66 is a linear drive. The drive 66 comprises a ball screw drive 72. The drive 66 for the base element 54 is partly integrated in the base element 54 and partly in the first side clamping wall 22. The base element 54 forms a receiving space for the spindle of the ball screw drive 72. The spindle of the ball screw drive 72 is stationary relative to the first side clamping wall 22. A nut running on the spindle of the ball screw drive 72 is secured to the base element 54. This allows the base element 54 to be moved relative to the first side clamping wall 22 in the further advancement plane 64 by means of the drive 66. During this movement the base element 54 entrains the bending tool 30 or the advancement plane 48 with it.

The drives 66, 68 for the base element 54 are arranged offset to the linear guides 56-62 for the base element 54 in the case shown. In an alternative embodiment, however, linear guides for the base element 54 may also be integrated in the drives 66, 68.

In the case shown, the drives 50, 52 for the bending tool 30 and the drives 66, 68 for the base element 54 differ at least in that the drives 50, 52 for the bending tool 30 are angled, whereas the drives 66, 68 for the base element 54 are straight. However, any combinations are possible. For example, only straight or only angled drives may be used. In addition, angular gears or the like may be used to offset some or more drives and/or to arrange them at an incline and/or at an angle. In principle, the drives 50, 52, 66, 68 may be adapted to an existing installation space and, if required, may be straight, angled, offset to each other, connected via a suitable power transmission, etc.

As described above, in an alternative embodiment, in addition, at least one of the drives 50, 52 for the bending tool 30 and/or at least one of the drives 66, 68 for the base element 54 may be a lever drive or another suitable drive for moving the bending tool 30 or the base element 54 along the corresponding linear guides 34-44, 56-62. For example, a hydraulic drive is also conceivable.

In the following, a bending operation of the bending machine 10 will be described in more detail. In FIG. 4 it may be seen that the first side clamping wall 22 has a first bending edge 74. In addition, the second side clamping wall 24 has a second bending edge 76. When bending with the first bending unit 26, bending is performed around the second bending edge 76. The section 14 of the workpiece 12 to be bent is bent here around the second side clamping wall 24 by exerting a bending force on the section 14 of the workpiece 12 to be bent by means of a suitable movement of the bending tool 30. In this case, the second bending edge 76 defines the bending axis 18. Similarly, when bending with the second bending unit 28, the first bending edge 74 defines the bending axis 18. In the following, only bending around the second bending edge 76, i.e. bending by means of the first bending unit 26, will be described in greater detail. However, the bending machine 10 is, as mentioned, designed for double bending, and therefore the description is to be understood analogously for bending with the second bending unit 28.

Figure 6:
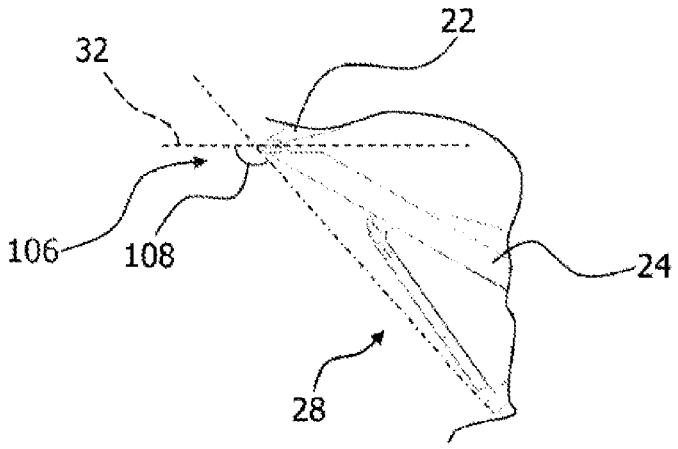
FIG. 6 shows a schematic side view of a further section of the bending machine.

FIG. 6 shows a schematic side view of a further section of the bending machine 10 The bending tool 30 may be moved in such a way that the workpiece 12 may be bent around the second bending edge 76 by at least 130°. In the case shown, the workpiece 12 may be bent around the second bending edge 76 by a maximum bending angle 108 of 140°. The maximum bending angle 108 is not shown to scale in FIG. 6, but only drawn schematically. The maximum bending angle 108 may be achieved if the second bending unit 28 on the second side clamping wall 24 is moved as far away as possible from the bending axis 18. The section 14 of the workpiece 12 to be bent may then be bent over an angle range of, for example, 140°, thus allowing small inside angles to be formed. If the first bending unit 26 is moved back in a similar way for bending with the second bending unit 28, the bending area 106 may extend over an angular range of, for example, up to 280°. If the section 14 of the workpiece 12 to be bent is so short that it does not reach the second bending unit 28 in a bent state, an even larger bending angle may be achieved, which is then limited by the second side clamping wall 24. In this case, for example, it is possible to bend by up to 150°. Depending on the design and/or application, these angles may also be larger than those mentioned.

Figure 8:
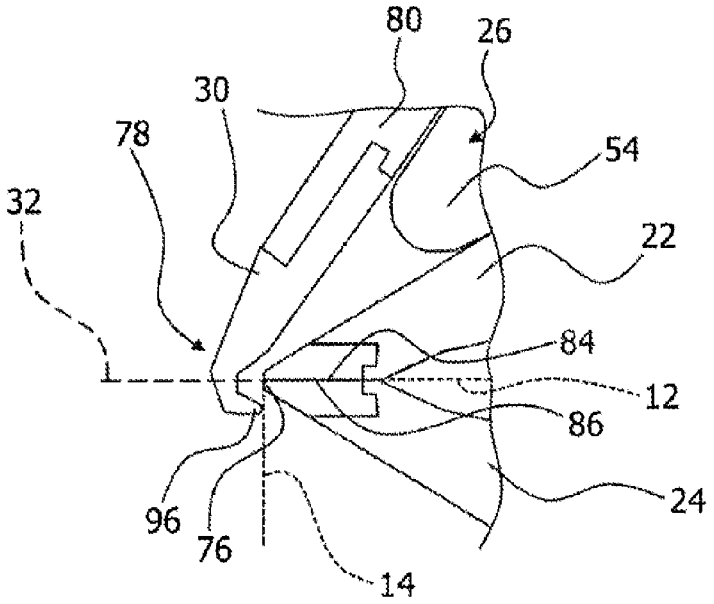
FIG. 8 shows a schematic side view of the section of FIG. 7 in a first bending state.
Figure 9:
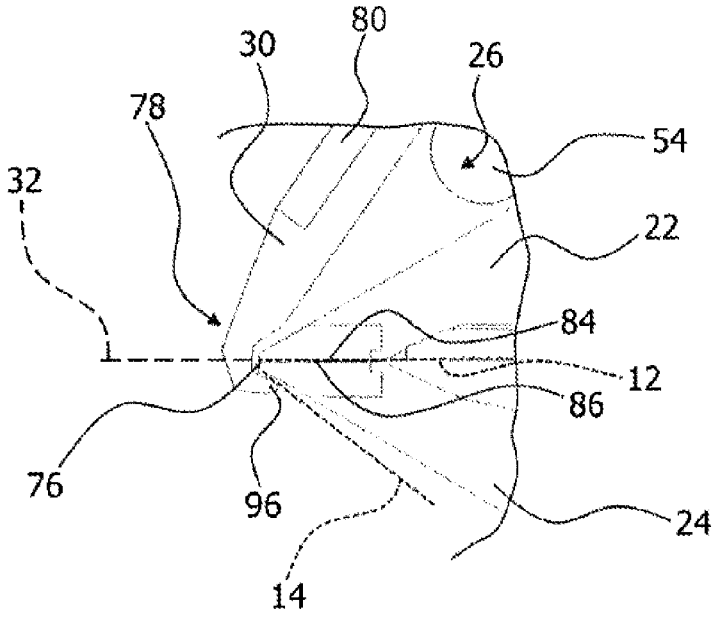
FIG. 9 shows a schematic side view of the section of FIG. 7 in a second bending state.

FIGS. 7-9 show side views of a further detail of the bending machine 10 in different states. In FIG. 7 the bending tool 30 has been moved up to the clamping plane 32. The bending tool 30 is placed against the section 14 of the tool 12 to be bent. FIG. 7 thus shows a state immediately before bending.

The bending tool 30 has a bending section 78, which is brought into contact with the workpiece 12 during reshaping. The bending section 78 may exert a bending force on the workpiece 12 when the bending tool 30 is moved relative to the workpiece 12.

The bending section 78 is hook-shaped. The bending section 78 has a hook-shaped cross-section perpendicular to the longitudinal direction 100.

In principle, however, other tools are also conceivable. Here, different bending tools are possible, for example with rounded, pointed, flat and/or angled bending sections. It is also conceivable that a cutting tool is used instead of a bending tool. In particular, the bending units 26, 28 may be equipped with different tools, and, for example, one of the tools may also be a bending tool and one of the tools may be a cutting tool. A person skilled in the art will select suitable tools for the specific application.

The bending section 78 has an inner surface 92 and an outer surface 94. The inner surface 92 is a hook inner surface. The inner surface 92, for example, is composed of a plurality of substantially flat sections which are rounded and merge into each other. Similarly, the outer surface 94 is composed of a plurality of substantially flat sections, with transitions being formed as rounded edges.

The bending section 78 also comprises an end section 96, which forms a foremost section of the bending tool 30. In one area of the end section 96, the inner surface 92 transitions into the outer surface 94. The end section 96 has a curved surface which is circular arc-shaped when viewed parallel to the longitudinal direction 100. According to a bending variant, the workpiece 12 may be bent with the end section 96 in such a way that the end section 96 always lies against workpiece 12 along a line extending parallel to the bending axis 18. The curved surface of the end section 96 rolls over the workpiece 12 so that there is preferably no sliding between workpiece 12 and bending tool 30, which could possibly scratch the workpiece 12. This rolling is produced in accordance with the invention by selecting a movement path of the bending tool 30 and thus of the end section 96 appropriately so that the end section 96 does not slip relative to the section 14 of workpiece 12 to be bent.

FIG. 8 shows a state in which the section 14 of the workpiece 12 to be bent has been bent through 90°. This bending was performed with the end section 96 of the bending section 78. In the state shown in FIG. 8, the end section 96 lies against the section 14 of the workpiece 12 to be bent.

Starting from the state shown in FIG. 7, bending of the section 14 of the workpiece 12 to be bent out of the clamping plane 32 is first performed in a push bending mode, in which the bending tool 30 is moved in a first direction. This first direction is variable. A corresponding movement of the bending tool 30 in the first direction takes place relative to the first side clamping wall 22 towards the bending area 106 and away from the clamping area 104.

If the workpiece 12 is to be bent by a larger angle, for example by an angle of 140°, bending is then carried out in a pull bending mode. In the pull bending mode, the bending tool 30 is moved in a second direction different from the first direction. The second direction is also variable. The second direction is substantially opposite the first direction. A corresponding movement of the bending tool 30 in the second direction takes place relative to the first side clamping wall 22 away from the bending area 106 towards the clamping area 104. In the pull bending mode, the section 14 of the workpiece 12 to be bent is brought into contact with the inner surface 92 of the bending section 78. The hook-shaped bending section 78 then pulls the section 14 of workpiece 12 to be bent further around the second bending edge 76 in the pull bending mode, starting from the state shown in FIG. 7.

By sequentially executing the push bending mode and the pull bending mode, the section 14 of workpiece 12 to be bent may thus initially be bent up to a limit angle, in the case shown about 90°, and starting from this limit angle may be further bent in the pull bending mode.

The bending machine 10 is equipped with an electronic control unit 82, which is shown schematically in FIG. 1, to control the movement of the bending tool 30 or the base element 54 in the advancement plane 48 or in the further advancement plane 64. The electronic control unit 82 is designed to produce a movement path for the bending tool 30 by superimposing at least two linear movements. In the case shown, these linear movements are the movement of the bending tool 30 in the advancement plane 48 and the movement of the base element 54 in the further advancement plane 64.

The invention further relates to a method for bending the workpiece 12, wherein the workpiece 12 is clamped in the clamping plane 32 by means of the side clamping walls 22, 24 and in which the section 14 of the workpiece 12 to be bent, for bending relative to the clamped section 16 of the workpiece 12 by means of the bending tool 30 linearly guided in the advancement plane 48, is reshaped about the bending axis 18 by moving the bending tool 30 linearly guided in the advancement plane 48. In this case, the bending tool 30 is moved along a movement path that is produced by superimposing a plurality of linear movements. In the case shown, these linear movements are the movement of the bending tool 30 in the advancement plane 48 and the movement of the base element 54 in the further advancement plane 64.

According to the embodiment shown, the bending machine 10 has a longitudinal extent of about 3.2 m. However, any other dimensions are conceivable. In this case, a number of linear guides and/or drives may be expediently adapted so that, for example, a larger number may be used for longer bending machines.

In principle, a bending mode is also conceivable in which both bending units 26, 28 are used simultaneously. For example, one bending unit may be used to provide a countersupport, so that the other bending unit bends a section to be bent around a bending tool of the countersupporting bending unit.

The invention claimed is:

1. A bending machine for bending a workpiece out of a flat material, a section to be bent being reshapable relative to a clamped section of the workpiece about at least one bending axis, the bending machine comprising:

a machine frame;

a first side clamping wall;

a second side clamping wall which is movable relative to the first side clamping wall;

at least one bending unit comprising at least one bending tool, the bending tool comprising a hook-shaped bending section;

the first side clamping wall and the second side clamping wall being designed to clamp the workpiece in a clamping plane; and the bending unit being arranged on at least one of the first and second side clamping walls;

wherein the bending unit has at least one linear guide, by means of which the bending tool is linearly guided in order to be moved in an advancement plane to bend the section of the workpiece to be bent relative to the clamped section of the workpiece about at least one bending axis, the bending unit comprising a base element mounted movably on the side clamping wall associated with the base element, the bending tool mounted to the base element so as to be linearly movable with respect to the base element; and wherein the bending unit is designed to move the bending tool in a push bending mode in a first direction and in a pull bending mode in a second direction, which is substantially opposite the first direction, wherein in the push bending mode, the hook-shaped bending section is pressed against the section to be bent, and the section to be bent is pushed away from the bending unit about the bending axis, and wherein in the pull bending mode the hook-shaped bending section is pressed against the section to be bent, and the section to be bent is pulled towards the bending unit about the bending axis, wherein the bending unit is designed to first partially reshape the section to be bent in the push bending mode and then further reshape the section to be bent in the pull bending mode.

2. The bending machine according to claim 1, wherein the side clamping walls define a clamping area of the bending machine, within which the clamped section of the workpiece is situated, and wherein the side clamping walls are arranged at an angle of less than 90° to each other and define a triangular cross-section of the clamping area.

3. The bending machine according to claim 1, wherein a bending unit is arranged on each of the side clamping walls.

4. The bending machine according to claim 1, wherein the bending unit comprises at least one drive for the bending tool, which is designed to move the bending tool in the advancement plane.

5. The bending machine according to claim 1, wherein the advancement plane intersects the clamping plane.

6. The bending machine according to claim 1, wherein the linear guide is integrated in the base element.

7. The bending machine according to claim 1, wherein the side clamping wall associated with the at least one bending unit comprises a surface facing away from the clamping plane, said surface being at an angle with respect to the clamping plane, and wherein the bending unit comprises at least one further linear guide mounted to the surface facing away from the clamping plane, by means of which the base element is linearly guided in order to move in a further advancement plane.

8. The bending machine according to claim 7, wherein the bending unit comprises at least one drive for the base element, which is designed to move the base element in the further advancement plane.

9. The bending machine according to claim 7, wherein the further linear guide is partially integrated into the side clamping wall associated with the bending unit.

10. The bending machine according to claim 7, wherein the further advancement plane is arranged parallel to the surface of the side clamping wall associated with the bending unit.

11. The bending machine according to claim 7, wherein the advancement plane intersects the further advancement plane, the base element is triangular in cross-section, and the advancement plane and the further advancement plane enclose an angle defined by the triangular geometry of the base element in cross-section.

12. The bending machine according to claim 1, wherein at least one of the first and second side clamping walls has a bending edge which defines the bending axis when bent by the bending unit, wherein the bending tool is movable so as to bend the workpiece around the bending edge by at least 120°.

13. The bending machine according to claim 1, wherein the bending tool comprises a hook-shaped bending section.

14. The bending machine according to claim 1, wherein the bending unit comprises a bending tool carrier, to which the bending tool is secured in an exchangeable manner.

15. The bending machine according to claim 1, wherein the base element comprises a plurality of elements, the plurality of elements collectively forming a three-sided cross-section.

16. A method for bending a workpiece out of a flat material, using a bending machine according to claim 1, wherein the workpiece is clamped in the clamping plane by the first side clamping wall and the second side clamping wall; and wherein a section of the workpiece to be bent, for bending relative to a clamped section of the workpiece by means of the bending tool linearly guided in the advancement plane, is reshaped about the bending axis by moving the bending tool linearly guided in the advancement plane.

17. The method according to claim 16, wherein the bending tool is moved along a movement path produced by superimposing a plurality of linear movements, the movement path being non-linear.

18. The bending machine according to claim 1 wherein the advancement plane is at an oblique angle to the clamping plane.

* * * * *